US007658027B2

(12) United States Patent
Jain et al.

(10) Patent No.: US 7,658,027 B2
(45) Date of Patent: Feb. 9, 2010

(54) WRISTBAND WITH SNAP CLOSURE AND PATIENT ID LABEL

(75) Inventors: Sanjay K. Jain, St. Louis, MO (US); Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 211 days.

(21) Appl. No.: 11/562,114

(22) Filed: Nov. 21, 2006

(65) Prior Publication Data

US 2007/0089342 A1 Apr. 26, 2007

Related U.S. Application Data

(63) Continuation of application No. 11/553,872, filed on Oct. 27, 2006, which is a continuation-in-part of application No. 10/870,500, filed on Jun. 17, 2004, now Pat. No. 7,520,077.

(51) Int. Cl.
*A44C 5/00* (2006.01)

(52) U.S. Cl. ..... 40/633; 40/665

(58) Field of Classification Search ..... 40/633, 40/665; 283/75
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Roos |
| 2,641,074 | A | 6/1953 | Richmond |
| 3,197,899 | A | 8/1965 | Twentier |
| 3,402,808 | A | 9/1968 | Yannuzzi |
| 3,660,916 | A | 5/1972 | McDermott et al. |
| 3,854,229 | A | 12/1974 | Morgan |

(Continued)

FOREIGN PATENT DOCUMENTS

| | | |
|---|---|---|
| EP | 1039431 | 9/2000 |

(Continued)

OTHER PUBLICATIONS

Avery Dennison DuraCard™.

(Continued)

*Primary Examiner*—Joanne Silbermann
(74) *Attorney, Agent, or Firm*—Thompson Coburn, LLP

(57) ABSTRACT

A wristband is assembled from a flexible preferably vinyl carrier and a preferably laminated ID label, the carrier having a panel portion and a strap portion with a snap closure located in a toe extension at the end of the carrier adjacent the panel. The strap has a series of holes, one of which is captured within the snap closure to attach the wristband to the wearer's limb. The laminated ID label has a pair of opposing slots, one of which slips over the strap to abut the panel and the other of which is captured by the snap closure to attach the label to the carrier. The panel portion has a relieved edge formed along its opposing sides which increases the comfort of the wristband as it is worn.

17 Claims, 5 Drawing Sheets

U.S. PATENT DOCUMENTS

| | | | |
|---|---|---|---|
| 4,004,362 | A | 1/1977 | Barbieri |
| 4,078,324 | A | 3/1978 | Wiebe |
| 4,179,833 | A | 12/1979 | Knodel |
| 4,226,036 | A | 10/1980 | Krug |
| 4,233,715 | A | 11/1980 | McDermott |
| 4,565,731 | A | 1/1986 | Komatsu et al. |
| 4,612,718 | A | 9/1986 | Golub et al. |
| 4,627,994 | A | 12/1986 | Welsch |
| 4,682,431 | A | 7/1987 | Kowalchuk |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | DeWoskin |
| 4,941,210 | A | 7/1990 | Konucik |
| 4,956,931 | A | 9/1990 | Selke |
| 4,978,144 | A | 12/1990 | Schmidt et al. |
| 4,991,337 | A | 2/1991 | Solon |
| RE33,616 | E | 6/1991 | Welsch |
| 5,026,084 | A | 6/1991 | Pasfield |
| 5,045,426 | A | 9/1991 | Maierson et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,351,993 | A | 10/1994 | Wright |
| 5,370,420 | A | 12/1994 | Khatib et al. |
| 5,381,617 | A | 1/1995 | Schwartztol et al. |
| 5,383,686 | A | 1/1995 | Laurash |
| 5,418,026 | A | 5/1995 | Dronzek, Jr. et al. |
| 5,427,416 | A | 6/1995 | Birch |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,581,924 | A | 12/1996 | Peterson |
| 5,586,788 | A | 12/1996 | Laurash |
| 5,595,404 | A | 1/1997 | Skees |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,687,903 | A | 11/1997 | Akridge et al. |
| 5,765,885 | A | 6/1998 | Netto |
| 5,785,354 | A | 7/1998 | Haas |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| 6,053,535 | A | 4/2000 | Washburn et al. |
| 6,067,739 | A | 5/2000 | Riley |
| 6,071,585 | A | 6/2000 | Roth |
| 6,092,321 | A | 7/2000 | Cheng et al. |
| 6,155,476 | A | 12/2000 | Fabel |
| 6,155,603 | A | 12/2000 | Fox |
| 6,159,570 | A | 12/2000 | Ulrich et al. |
| 6,303,539 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| 6,611,962 | B2 | 9/2003 | Redwood et al. |
| 6,641,048 | B1 | 11/2003 | Schintz et al. |
| 6,685,228 | B2 | 2/2004 | Riley |
| 6,748,687 | B2 | 6/2004 | Riley |
| 6,807,680 | B2 | 10/2004 | Sloot |
| 6,836,215 | B1 | 12/2004 | Laurash et al. |
| 6,863,311 | B2 | 3/2005 | Riley |
| 7,017,293 | B2 | 3/2006 | Riley |
| 7,017,294 | B2 | 3/2006 | Riley |
| 7,047,682 | B2 | 5/2006 | Riley |
| 7,222,448 | B2 | 5/2007 | Riley |
| 7,240,446 | B2 | 7/2007 | Bekker |
| 2002/0176973 | A1 | 11/2002 | Keiser |
| 2003/0001381 | A1 | 1/2003 | Riley |
| 2003/0003249 | A1 | 1/2003 | Benim et al. |
| 2003/0011190 | A1 | 1/2003 | Ryan |
| 2004/0128892 | A1 | 7/2004 | Valenti |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0279001 | A1 | 12/2005 | Riley |
| 2005/0281989 | A1 | 12/2005 | Finger |
| 2006/0230661 | A1 | 10/2006 | Bekker |
| 2006/0236578 | A1 | 10/2006 | Saint et al. |
| 2006/0261958 | A1 | 11/2006 | Klein |
| 2007/0089342 | A1 | 4/2007 | Jain et al. |
| 2007/0120358 | A1 | 5/2007 | Waggoner et al. |
| 2007/0243361 | A1 | 10/2007 | Riley et al. |
| 2008/0098636 | A1 | 5/2008 | Greer |
| 2009/0193701 | A1 | 8/2009 | Greer |

FOREIGN PATENT DOCUMENTS

| | | | |
|---|---|---|---|
| FR | 2806594 | A | 9/2001 |
| GB | 960859 | | 6/1964 |
| GB | 2045718 | | 11/1980 |
| GB | 2160492 | | 12/1985 |
| GB | 2228915 | A | 9/1990 |
| JP | 5-61777 | | 8/1993 |
| JP | 08-190350 | | 7/1996 |
| JP | 3032299 | | 12/1996 |
| JP | 10-207374 | | 8/1998 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | 9502877 | | 1/1995 |
| WO | WO 96/12618 | | 5/1996 |
| WO | WO 98/23081 | | 5/1998 |
| WO | WO 99/18817 | | 4/1999 |
| WO | WO 02/39412 | | 5/2002 |
| WO | WO 03/003331 | | 1/2003 |
| WO | WO 2004/028826 | | 4/2004 |
| WO | WO 2006/007356 | | 6/2005 |
| WO | WO 2005/064574 | | 7/2005 |
| WO | 2007/021375 | | 2/2007 |
| WO | 2007/133906 | | 11/2007 |
| WO | 2009099787 | A1 | 8/2009 |

OTHER PUBLICATIONS

Avery® Laminated Identification Cards #5361.

Brochure entitled: "Color-Bar® Click Strip™" Label System; Smead Manufacturing Company; Date Unknown; Form No. SSS-CS-00.

Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions™; Date Unknown; Form No. SSS-RC1-00.
Sample of Standard Register Labels.
Standard Register, *P.S. Magazine*, Fall 1998, Dayton, Ohio.
Gretchen Berry, "Wrist Watch," *Advance for Healthcare Information Professionals*, Feb. 15, 1999.
Sample of Standard Register Label.
"Yes, Sir, That's My Baby!," *Material Management in Health Care*, Feb. 1999, vol. 9, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
International Search Report for PCT/US2009/031979 dated Mar. 9, 2009.
Office Action for U.S. Appl. No. 11/553,891 dated Mar. 19, 2009.
ID Warehouse (http://web.archive.org/web/20050131235601/http://idwarehouse.com/) Jan. 31, 2005. p. 1: WB1908, Stock Vinyl Wristband.
Office Action for U.S. Appl. No. 11/373,923 dated Jun. 1, 2009.
Office Action for U.S. Appl. No. 11/374,273 dated May 26, 2009.
Office Action for U.S. Appl. No. 11/735,078 dated May 28, 2009.
Office Action for U.S. Appl. No. 11/763,615 dated May 6, 2009.
International Preliminary Report on Patentability (Chapter II) for PCT/US2008/059616 dated Jul. 14, 2009.
International Search Report for PCT/US2009/039183 dated Jun. 25, 2009.
Office Action for U.S. Appl. No. 11/203,601 dated Aug. 17, 2009.
Office Action for U.S. Appl. No. 11/754,812 dated Jul. 24, 2009.
Office Action for U.S. Appl. No. 11/456,928 dated Jun. 15, 2009.
Office Action for U.S. Appl. No. 11/553,872 dated Jun. 17, 2009.

WRISTBAND WITH SNAP CLOSURE AND PATIENT ID LABEL

CROSS-REFERENCE TO RELATED APPLICATIONS

This application is a continuation of application Ser. No. 11/553,872, filed Oct. 27, 2006, currently pending, and a continuation-in-part of application Ser. No. 10/870,500, filed Jun. 17, 2004, also currently pending, the disclosures both of which are incorporated herein by reference. Application Ser. No. 11/553,872 is related to two other applications filed concurrently therewith on Oct. 27, 2006. They are "Wristband with Contoured Comfort Sides" having application Ser. No. 11/553,873; and "Laminate Web Wristband" having application Ser. No. 11/553,891; the disclosures of which are also incorporated herein by reference.

BACKGROUND AND SUMMARY OF THE INVENTION

The assignee of the present invention is in the business of making and selling self laminating wristbands of the type shown in a number of its patents including U.S. Pat. No. 5,933,993; U.S. Pat. No. 6,000,160; U.S. Pat. No. 6,067,739; U.S. Pat. No. 6,438,881; U.S. Pat. No. 6,510,634; U.S. Pat. No. 6,748,687; U.S. Pat. No. 7,047,682; U.S. Pat. No. 7,017,293; and U.S. Pat. No. 7,017,294, the disclosures of which are incorporated herein by reference. While these are good and valuable inventions and have met with great commercial success, most of the wristband forms disclosed in these prior patents are directed to a market segment comprised of customers who recognize the value of the product through its superior design providing superior performance and ease of use as well as the cost savings achieved by savings of medical staff time in processing accurately and reliably the in-coming patients or others using the wristbands. There yet remain those in different market segments who for their own reasons are more closely focused on the cost of purchasing the wristband and use that parameter principally if not exclusively in making their buying decisions. For this market segment, buyers are willing to sacrifice quality, ease of use and reliability of identification/use as a trade off against initial wristband cost and buy wristbands not offering the many advantages and features of the assignee's previously patented designs.

Typical of the prior art designs bought and sold for this market segment include a simple vinyl wristband having a wider "panel" area for receiving a self adhering paper label separately printed with the wearer's name, etc., a strap portion extending to one side of the panel with a series of holes punched in the strap to allow for sizing the wristband to different lengths, and a snap closure at the other end of the panel comprised of a pin for insertion through one of the strap holes and into a receiver to secure the pin and thus complete the attachment of a wristband to a wearer's wrist or ankle. For convenience, the word "wrist" when used herein shall include any limb such as a wrist or ankle and the word "wristband" shall include bands wrapped around any limb such as either a wrist or ankle. Generally a cheap vinyl or other plastic material is used to make these wristbands, and they may be formed in sheets with adjacent wristbands being flipped end-to-end to allow them to nest and thereby save on wasted material. The snap closures are also generally made of plastic and are mounted in a "toe" vinyl extension from the panel side opposite the strap. This toe extension generally comprises a tab portion aligned with and opposite to the strap and within which the snap closure is located. The snap closure includes a pin centered along the same center axis as the strap, which centers the snap closure to the panel and strap holes so that when the wristband is applied by attaching the strap to the snap closure the strap remains aligned with the panel.

While this construction is much less expensive, it does not provide the significant benefit of a laminated protective layer over the printed wearer's name and other identifying information such as a bar code. In this prior art wristband, that information is routinely printed (or even handwritten) separately on a paper label and then the label is applied to the carrier such as with a layer of adhesive. For many medical applications, the harsh environment including exposure to bodily fluids, etc. in which these wristbands must perform often times can lead to early label failure and needed replacement, or even to errors in reading the recorded information from the label. If not timely replaced, disastrous results such as administering the wrong medication, providing the wrong or improper treatment, etc. can occur. For these reasons, in many instances the savings provided by the reduced purchase price for a single wristband is lost or even exceeded in cost when multiple wristbands are used.

To solve these and other problems in the prior art, and to provide the benefits of a wristband with laminated protection for wearer information but in a less costly product, the inventors herein have succeeded in conceiving of and developing an inexpensive wristband including a carrier onto which preferably a printed, laminated ID label may be securely mounted with an inexpensive snap closure and within the "envelope" of the underlying panel so that it is protected from contact with the user's wrist or ankle as the wristband is worn. While preferably the label or tag mounted to the wristband carrier is of the assignees own previous design of a self laminating label, it is noted that other labels could be used. The carrier includes a toe extension which unlike the known prior art designs is offset and extends further to the outside of the panel, with the pin portion of the closure mounted off the centerline of the panel and strap but positioned so that the ID label is captured between it and the fold of the toe as the receiver is folded over to fasten the closure. This arrangement provides not only automatic correct positioning of the label onto the carrier but also the additional benefit of using less material, and thus generating less waste, than if the toe were merely made longer. In this design and for this market segment, especially considering that wristbands such as these are used annually by the millions if not billions, the small but incremental cost savings achieved through this arrangement can be significant. The laminated ID label preferably has a slot at either end, one slot sized to slide over the strap and the other slot sized and located to allow centering of the ID label on the panel, it being centered by the close fit between the pin and fold in the toe extension. The use of a slot instead of a hole allows for minor tolerances in manufacturing, although many different opening sizes and shapes could be used.

Yet another feature incorporated into the present invention is a relieved edge formed along the longitudinal opposing edges of the carrier which renders the panel edge flexible and more comfortable to wear. This flexibility reduces the tendency of the edge to pinch, or dig into, the skin as a wearer moves his hand and wrist, or ankle. Instead, the relieved edge readily flexes away from the skin which reduces any abrasive or cutting effect to the skin. There are various patterns which may be used and which are contemplated by the inventor to exhibit the desired effect. Each of these patterns essentially adds yieldability, or extends the length, of the edge which provides "give" so that there is less pressure placed on the wearer's skin at the edge than in the body of the panel area.

The principal advantages and features of the invention are briefly explained above, but a more thorough understanding thereof may be gained through reading the description below while referring to the appended drawings.

DETAILED DESCRIPTION OF THE PREFERRED EMBODIMENT

Figure 1:
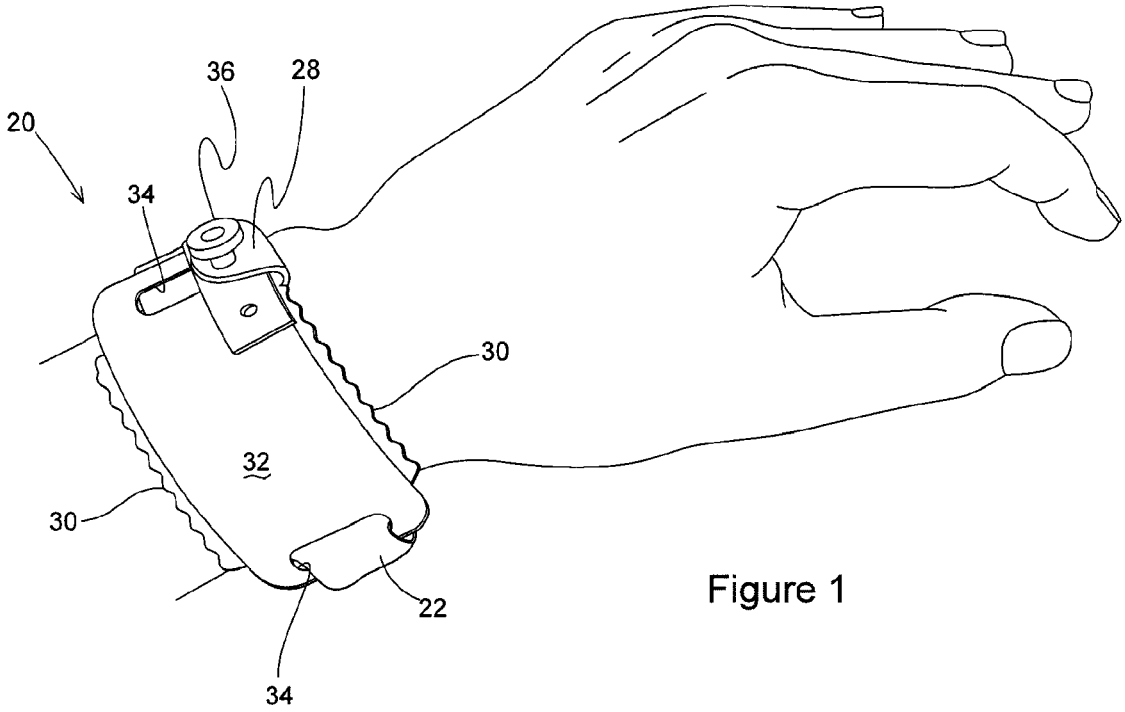
FIG. 1 is a perspective view of the wristband of the present invention assembled and worn on the limb of a user.
Figure 2:
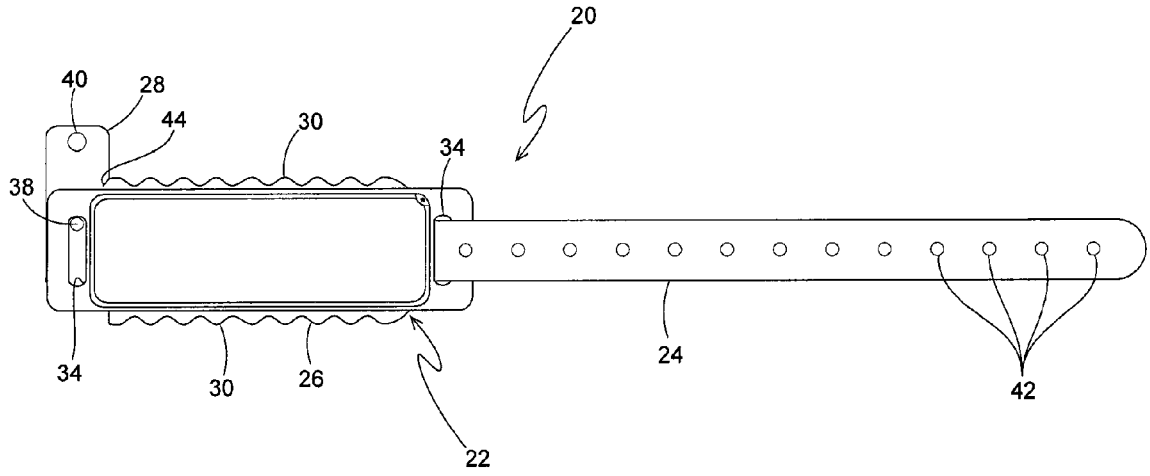
FIG. 2 is a top view of an assembled wristband, with the slotted laminated ID label slipped over the strap and the male portion of the snap closure.

As shown in FIGS. 1 and 2, the wristband 20 of the present invention comprises a carrier 22 having a strap portion 24, a panel portion 26, and a toe 28 extending to the side of the panel 26. The carrier 22 is preferably made of a thin and flexible vinyl or other suitable relatively inexpensive plastic material and preferably has a thickness of about 15-20 mil, for flexibility and cost reasons. Along an upper and lower longitudinal edge of the panel 26 is a relieved edge 30. This relieved edge takes on a generally scalloped shape extending along substantially the entirety of the longitudinal edge. As discussed below, the relieved edge 30 may have a number of alternative shapes. A self laminating ID label 32 preferably has a pair of slots 34 at opposing sides thereof, with the slots 34 preferably having approximately the same size, shape and relative placement on the label 32. The slots 34 are sized to allow the strap portion 24 to slide therethrough but not over the panel portion 26. Mounted in the toe 28 is a snap closure 36 comprised of a male or pin portion 38 and a hole or receiver portion 40. The pin 38 is shown in FIG. 2 to be just off the centerline or central axis of the strap portion 24 and panel portion 26, with the strap portion having a plurality of holes 42 for positioning within the snap closure to attach the strap portion and thereby not only secure the label 32 but also mount the wristband to the wearer's wrist or ankle. As best shown in FIG. 2, the pin 38 and slot 34 capture the edge of the label 32 so that as the receiver 40 is folded over to attach to the pin 38, the inside folded edge of the toe 28 abuts the edge of the label 32 to position the label substantially within the envelope of the panel 26. To facilitate this positioning, a slit 44 in the carrier may be provided to allow the toe 28 to bend further inboard of the relieved edge 30.

Figure 3:
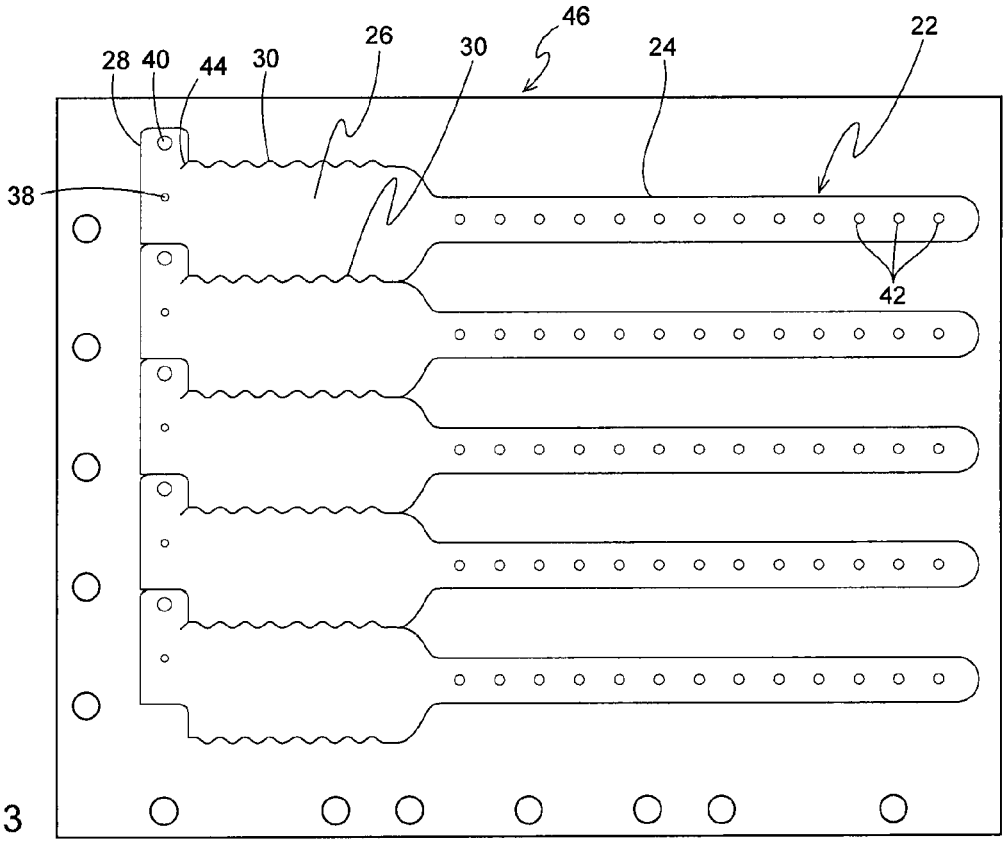
FIG. 3 is a top view of a page or sheet of a plurality of wristband carriers.

As shown in FIG. 3, a plurality of carriers 22 may be formed in a page 46, with adjacent carriers having a relieved edge 30 pattern that allows the adjacent edges to be formed with a single die cut. The carriers 22 may be conveniently formed in the page with die cuts so that the carriers may be readily separated from the page as they are used.

Figure 4:
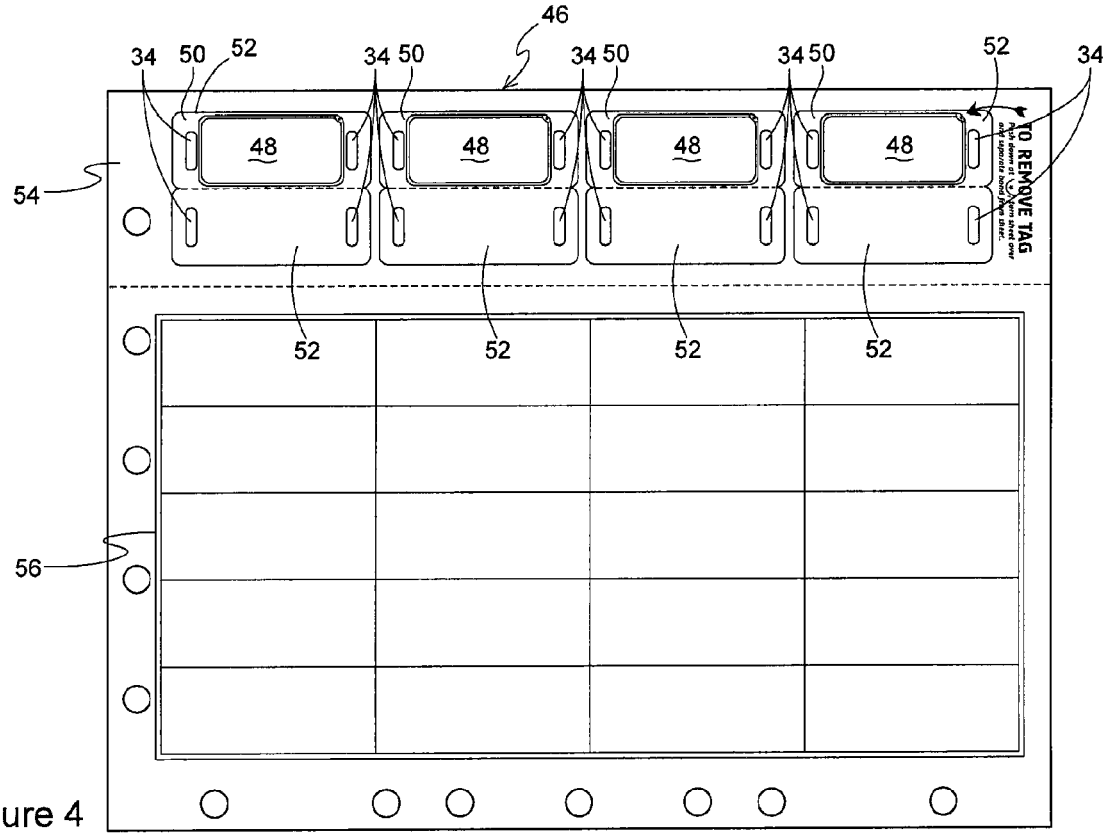
FIG. 4 is a top view of page or sheet of a matrix of self adhering labels and an upper portion having four self laminating, slotted ID labels or tags for use with the carriers as shown in FIG. 3, and FIGS. 5A-5E are a series of top views each depicting a different embodiment of a relieved edge along the carrier panel edges.

As shown in FIG. 4, the laminated ID labels 32 are preferably self laminating labels of the type previously described in several of the above identified patents previously issued to the assignee hereof. Briefly, each ID label comprises a paper stock or face stock printable area 48 to which may be applied a patient's name, a bar code identifying the patient or cross referencing him to a data base, the attending doctor's name, etc. A clamshell laminating portion 50 has a pair of joined panels 52 for encapsulating the print area 48 and is formed from a transparent laminate with a pair of opposing slots in each panel 52. The panels 52 have a layer of adhesive so that after separation of the labels 32 from the page 54, and after the page 54 has been processed through a printer, the panels 52 are folded over onto each other to encapsulate the print area 48 and form the ID label for use with the carrier 22. Also as described in several of the other patents incorporated herein by reference, the page 54 may have a matrix of self adhering labels 56 which may be printed at the same time and be used on charts, etc. While a self laminating label or tag as described above is the preferred embodiment of the present invention, it is within the scope of the invention that other labels, tags could be used. These could be laminated or not. These could be rigid or flexible. These could be made of paper stock or other materials. It merely is desired that the labels, tags have the features as claimed below including one or more slots or holes or openings to accommodate mounting thereof on the carrier.

Figure 5A:
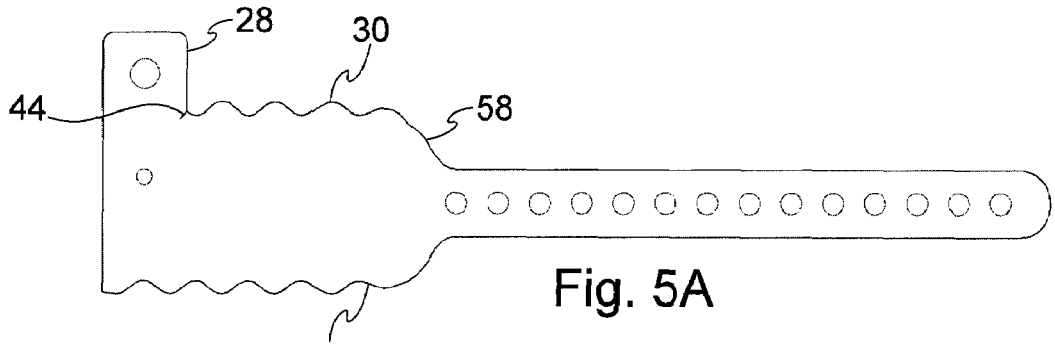
Figure 5B:
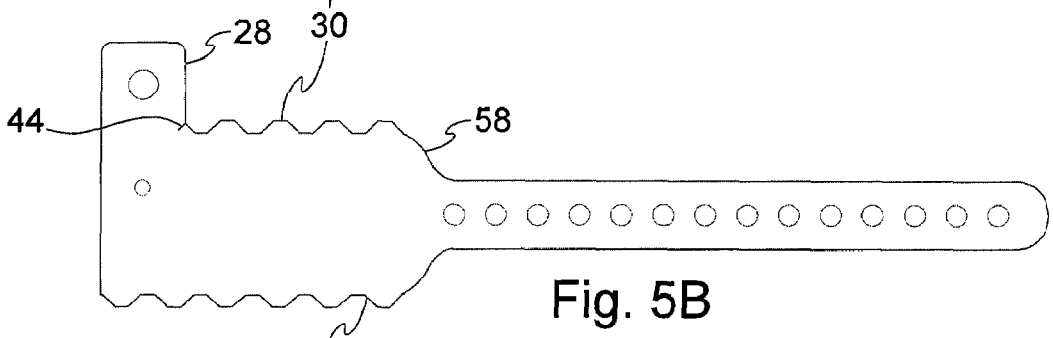
Figure 5C:
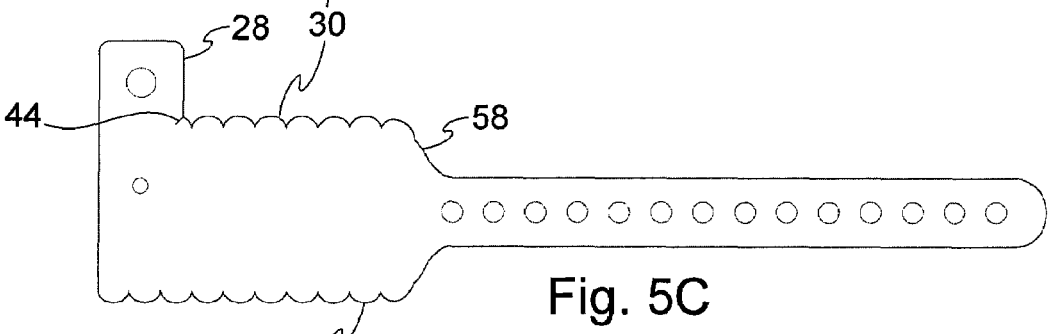
Figure 5D:
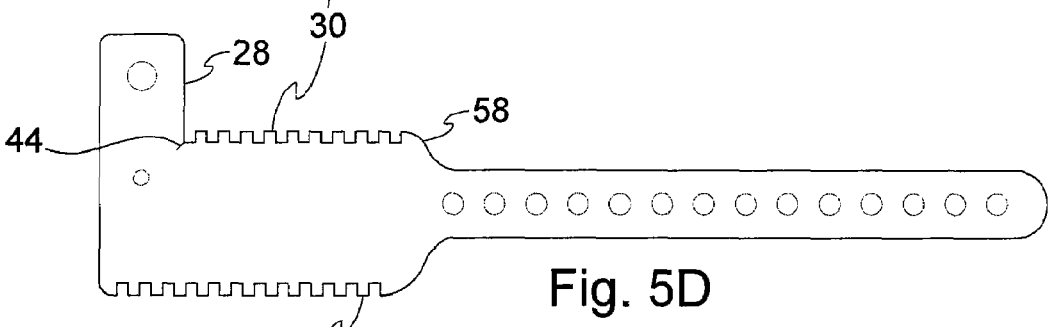
Figure 5E:
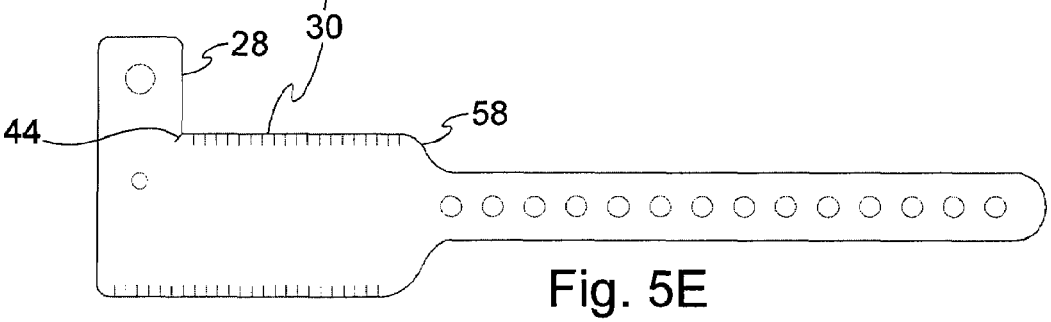

FIG. 5A-E depict different shapes and designs for the relieved edge 30 which are all believed to exhibit the desired effect, i.e. that of softening or weakening or lengthening the edge to increase the comfort of the wearer. As shown in FIG. 5A, the relieved edge may be shaped as a generous curved or scallop, preferably extending from the front shoulder 58 of the panel 26 to the toe 28 and along both the top and bottom sides or edge of the panel 26. As shown in FIG. 5B, the relieved edge 30 may be shaped as more pronounced and regular, with flattened pyramids extending outwardly. As shown in FIG. 5C, the relieved edge 30 may be shaped as a continuous half or semi-circle pattern, resembling an arrangement of petals along the edge. As shown in FIG. 5D, the relieved edge may be shaped as a Greek key, or series of spaced rectangular flaps. As shown in FIG. 5E, the relieved edge may be formed by a series of die cuts which creates a series of adjacent rectangular flaps. It is noted that several of these relieved edge designs, such as that shown in FIGS. 5A, 5B, 5D and 5E, may be conveniently arranged such as by offset to allow for adjacent positioning of carriers on the same page and the formation of the relieved edge for two adjacent carriers with a single die cut.

As disclosed and claimed herein, a low cost plastic carrier securely mounts a self laminating ID label with a snap closure and has a comfort edge to decrease any chance for injury to the wearer. The carriers are conveniently made in sheets or pages separately from the multiply construction of the ID labels which themselves are formed in sheets or pages. The principal advantages and features of the present invention have been explained in illustrative manner above. However, such explanation should be considered as merely illustrative and the invention should be considered as encompassing such alternative and supplementary variations as would be apparent to those of skill in the art. For example, the preferred embodiment discloses that the ID label has a pair of slots at opposing ends. One slot could readily be replaced by a hole, or other design opening just so long as it would permit it to be secured to the snap closure. A snap closure is disclosed although other design closures could be used and should be considered as equivalent thereto. The receiver portion has been disclosed as being mounted outboard but the male pin could be located there instead. A slit has been disclosed as assisting the toe to be folded over to locate the ID label inboard of the panel edge, but the use of a slit is considered optional, and even other structure or design could be used to the same purpose. Several designs for the relieved edge have been disclosed although others could be used to the same effect. For example, a folded over edge which would provide effectively a "bumper" could also be used. Other variations would be apparent, and the invention is intended to be limited solely by the legal scope of the claims appended hereto.

What is claimed is:

1. A wristband comprising a carrier and a label, the carrier having a strap of a first smaller width, a panel of a second larger width with a flexible toe formed at an end thereof, and a closure mounted in the flexible toe for at least securing the label to the carrier, the closure having one of a male or a female portion mounted outboard of the panel, the label having a width smaller than the panel and a slot sized to slide over the strap but not the panel and another opening comprising a second slot sized and positioned to receive the closure and fix the label in position between a fold of the flexible toe and the closure as it is closed, the label lying substantially within the periphery of the panel as the closure is closed and wherein the wristband may be assembled by sliding the label slot over the strap to position the label opening over the closure and the closure closed to thereby secure the label in close juxtaposition to the panel as the wristband is affixed about the wearer's limb.

2. The wristband of claim 1 wherein the label slots are positioned near opposing ends of the label.

3. The wristband of claim 2 wherein the label comprises a face stock imaging area laminated on both sides by a laminate layer.

4. The wristband of claim 3 wherein the closure comprises a snap closure with a pin portion of the snap closure comprising the male portion and a receiver portion of the snap closure comprising the female portion and with one of said pin portion and receiver portion being mounted on the flexible toe, the second label slot being sized to freely slide about the pin.

5. The wristband of claim 4 wherein the flexible toe extends perpendicular to the strap and is sized so that as it is folded over to close the snap closure the fold created thereby is substantially aligned with an edge of the panel.

6. The wristband of claim 5 wherein the strap has at least one hole along its length, and wherein said at least one hole is captured by the closure to thereby affix the wristband about the wearer's limb.

7. The wristband of claim 1 wherein the carrier panel has a relieved edge on at least one side thereof.

8. A wristband comprising a carrier and a label, the carrier comprising a strap portion and a panel portion with a closure positioned at an end of the panel portion, the closure having one of a male portion or a female portion mounted outboard of the other of the male or female portion, the label having an opening sized to receive the male portion of the closure and a slot sized to allow the strap to pass therethrough wherein the slot width is greater than the strap width but smaller than the panel width with the opening and slot being located so that as the strap passes through the slot the slot substantially abuts the panel edge and the label is substantially aligned with the panel portion as the label opening is captured within the closure, the slot being positioned along with the label opening on opposite ends of the label so that the label may be secured to the carrier by both of the slot and opening.

9. The wristband of claim 8 wherein the label comprises a printable face stock area surrounded by a laminating layer.

10. The wristband of claim 9 wherein the strap has at least one hole along its length, and wherein said at least one hole is captured by the closure to thereby affix the wristband about the wearer's limb.

11. The wristband of claim 8 further comprising a relieved edge formed along at least one side of the panel portion.

12. A wristband comprising a carrier and a label, the carrier comprising a strap portion and a panel portion, with a closure positioned on a flexible toe at an end of the panel portion, the closure having one of a male portion or a female portion mounted outboard of the other of the male portion or female portion, the label having at least one slot and one opening, the label opening comprising a second slot with said slots being substantially the same size and located at opposite ends of the label, wherein the slots are located so that one slot may be slid over the strap and the other placed within the closure as a hole in the strap is co-located within the closure and closed to affix the wristband about a wearer's limb.

13. The wristband of claim 12 wherein the label comprises a printable face stock area surrounded by a laminating layer.

14. The wristband of claim 13 wherein the closure is a snap closure, and the flexible toe is sized and located so that the label is substantially aligned with the panel portion as the snap closure is closed over the label slot.

15. The wristband of claim 14 further comprising a slit formed in the panel portion and positioned to allow the toe to be folded inboard from the panel portion edge to thereby position the label within the edge of the panel portion.

16. The wristband of claim 12 wherein the closure is a snap closure, and the flexible toe is sized and located so that the sides of the label are inboard of the panel portion as the snap closure is closed over the label slot.

17. The wristband of claim 12 further comprising a relieved edge formed along at least one side of said panel portion.

* * * * *

UNITED STATES PATENT AND TRADEMARK OFFICE

CERTIFICATE OF CORRECTION

PATENT NO. : 7,658,027 B2
APPLICATION NO. : 11/562114
DATED : February 9, 2010
INVENTOR(S) : Sanjay Jain et al.

It is certified that error appears in the above-identified patent and that said Letters Patent is hereby corrected as shown below:

On the title page item (63), replace:

"Continuation of application No. 11/553,872, filed on Oct. 27, 2006, which is a continuation-in-part of application No. 10/870,500, filed on Jun. 17, 2004, now Pat. No. 7,520,077"

With

"Continuation of application No. 11/553,872, filed on Oct. 27, 2006; and continuation-in-part of application No. 10/870,500, filed Jun. 17, 2004, now Pat. No. 7,520,077"

Signed and Sealed this

Eighteenth Day of May, 2010

David J. Kappos

David J. Kappos
*Director of the United States Patent and Trademark Office*